United States Patent [19]

Hirata

[11] Patent Number: 4,713,528

[45] Date of Patent: Dec. 15, 1987

[54] COOKING APPARATUS WITH TIMER

[75] Inventor: Hidetoshi Hirata, Nagoya, Japan

[73] Assignee: Kabushiki Kaisha Toshiba, Kawasaki, Japan

[21] Appl. No.: 788,872

[22] Filed: Oct. 18, 1985

[30] Foreign Application Priority Data

Nov. 9, 1984 [JP] Japan ..... 59-235190

[51] Int. Cl.[4] ..... H05B 1/02

[52] U.S. Cl. ..... 219/492; 219/10.55 B; 219/506; 219/493

[58] Field of Search ..... 219/492, 493, 507, 508, 219/494, 501, 10.55 B, 506, 10.77; 426/231; 99/325, 328, 331

[56] References Cited

U.S. PATENT DOCUMENTS 4,300,037 11/1981 Padden ..... 219/492

4,367,399 1/1983 Anthony et al. ..... 219/497

FOREIGN PATENT DOCUMENTS 578709 7/1946 United Kingdom .
983542 2/1965 United Kingdom .
1055645 1/1967 United Kingdom .
1236102 6/1971 United Kingdom .
1311476 3/1973 United Kingdom .
2019041 10/1979 United Kingdom .
1560336 2/1980 United Kingdom .
2143054 1/1985 United Kingdom .

*Primary Examiner*—M. H. Paschall
*Attorney, Agent, or Firm*—Cushman, Darby & Cushman

[57] ABSTRACT

A cooking arrangement including a timer function which enables cooking operation of the apparatus to be automatically continued without carrying out a restarting operation even if the timer operation is cancelled while cooking is being carried out under timer control.

7 Claims, 3 Drawing Figures

COOKING APPARATUS WITH TIMER

BACKGROUND OF THE INVENTION

The present invention relates in general to cooking apparatus. More specifically, the invention relates to an inductive heat cooking apparatus, which produces a high-frequency magnetic field from a heating coil and carries out cooking by self-heating of a saucepan caused by the high-frequency magnetic field.

Generally, inductive heat cooking apparatuses include a heating coil for generating a high-frequency magnetic field. This high-frequency magnetic field generates an eddy current flowing in a saucepan, which heats the saucepan. Thus, inductive heat cooking is carried out by self-heating due to eddy current losses in the saucepan.

Although inductive heat cooking apparatuses are adapted for prolonged cooking such as needed to cook stew or to fry or to keep food warm, the user may want to be away from the apparatus during prolonged periods of cooking. When the user must be away, the most safe procedure is to cut off power to the apparatus. However, this prevents cooking from progressing. Nonetheless, it is dangerous to continue cooking for a long period during which the user is absent.

In view of the above-described circumstances, it has been considered to equip an inductive heat cooking apparatus with a timer device. When leaving the apparatus during cooking, the user may set an appropriate period of time on the timer device, during which cooking can proceed in his absence. It would not be necessary to cut off power to the apparatus every time the user left the apparatus. When the returns, following a timer controlled cooking, he can cancels timer operation, whereupon the cooking is temporarily stopped. The user must then take some action to re-start the cooking process.

It has also been considered to provide a switch which permits the user to set a "use" or "non-use" of the timer. When the switch is set to a "use" status, the cooking is stopped by the timer operation after the set time has elapsed. When the set of the switch is cancelled, i.e. changed to the "non-use" status, while the timer is in use, the timer restriction is released and the cooking apparatus is returned to continuous cooking. In other words, it may be set to a continuous cooking mode simply by canceling the set of the switch. Using such an arrangement, the user would no longer need to carry out some procedure to re-start cooking. However, when the user sets the timer, it would still be necessary to carry out at least two operations. The user would have to set the timer and operate the change over switch. Such a procedure might be confusing for some users, and the controls would be more complicated than would be desireable.

SUMMARY OF THE INVENTION

It is an object of the present invention to provide a timer cooking method and an improved inductive heat cooking apparatus equipped with a timer device wherein, when a user releases timer restriction i.e. cancels operation of the timer, the cooking operation is not automatically stopped. Rather, it continues uninterrupted and without the need to operate any other switches or controls, thus avoiding the complicated operation of the timer, and reducing the manufacture cost of the apparatus.

BRIEF DESCRIPTION OF THE DRAWINGS

These and other objects and advantages of this invention will become more apparent and more readily appreciated from the following detailed description of the presently preferred exemplary embodiment of the invention, read in conjunction with the accompanying drawings wherein.

DETAILED DESCRIPTION OF THE PRESENTLY PREFERRED EXEMPLARY EMBODIMENT

An embodiment of the present invention will be described in more detail with reference to the accompanying drawings.

Figure 1:
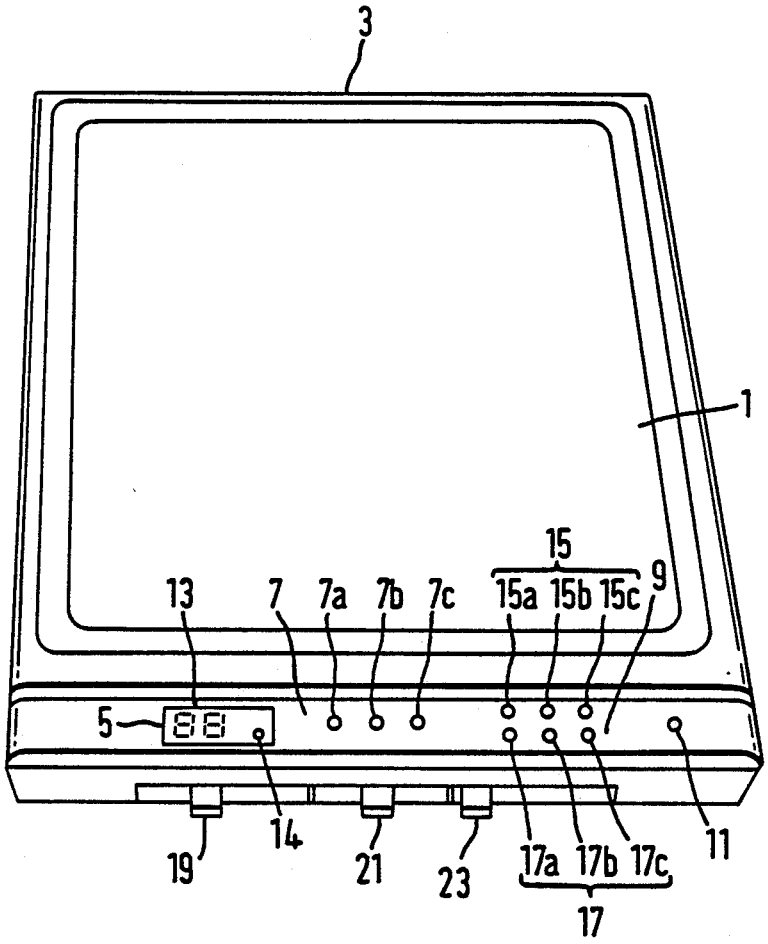
FIG. 1 is a perspective front view of the preferred embodiment of a cooking apparatus according to this invention.

Referring to FIG. 1, there is shown a perspective front view of an inductive heat cooking apparatus. A top plate, made of reinforced glass, is mounted on an inductive heat cooking apparatus body 3. A timer display 5, cooking mode display 7, power level display 9 and power source lamp 11 are provided on one side part of the upper surface of apparatus body 3. Timer display 5 includes a two figure segment-type display 13 indicating the set time and a flashing indicator 14. Flashing indicator 14 includes a light-emitting diode which flashes every second to indicate the execution of the timer operation. Cooking mode display 7 includes three light-emitting diodes **7*a*, 7*b* and 7*c* arranged in a line. An indication by first light-emitting diode 7*a* denotes a "HEATING" mode, an indication by second diode 7*b* denotes a "FRYING" mode and an indication by third diode 7*c*** indicates a "KEEP WARM" mode.

Power level display 9 includes a power control display 15 and temperature control display 17 arranged in parallel. Control display 15 and 17 each include three light-emitting diodes. In power control display 15 (upper line), a first light-emitting diode **15*a* indicates "LOW" level, a second light-emitting diode 15*b* indicates "MEDIUM" level and a third light-emitting diode 15*c* indicates "HIGH" level. In temperature control display 17 (lower line), a first light-emitting diode 17*a* indicates "LOW" level, a second light-emitting diode 17*b* indicates "MEDIUM" level, and a third light-emitting diode 17*c*** indicates "HIGH" level.

A timer set knob 19, cooking mode select knob 21 and power level set knob 23 are slidably provided at a side surface of body 3 corresponding to timer display 5, cooking mode display 7 and power level display 9, respectively. The left most position of timer set knob 19 in FIG. 1 corresponds to the zero graduation (i.e. zero-set position), and the rightmost position in the Figure corresponds to the maximum time setting. The leftmost position of cooking mode select knob 21 in FIG. 1 corresponds to the "HEATING" mode, the middle position of cooking mode select knob 21 as shown in the Figure corresponds to the "FRYING" mode and the rightmost position corresponds to the "KEEP WARM" mode. The leftmost position of power level set knob 23 as shown in FIG. 1 corresponds to an "OFF" position and the rightmost position corresponds to the "HIGH" level.

Figure 2:
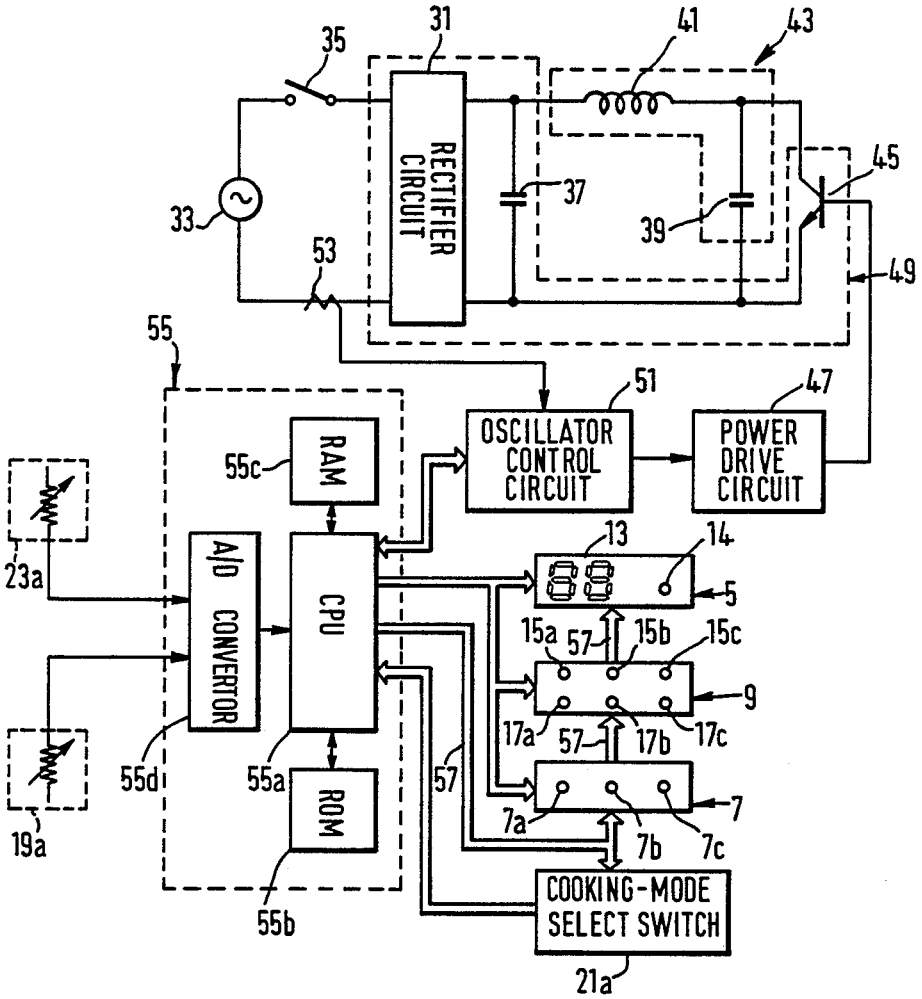
FIG. 2 is a schematic view of the control circuit of the cooking apparatus according to the present invention.

Referring to FIG. 2, the control circuit of the cooking apparatus will be described hereinafter. A rectifier circuit 31, including four diodes arranged in a conventional manner, is connected to an A.C. power source 33 through a power switch 35. A smoothing capacitor 37 is connected to the output terminals of rectifier circuit 31. A capacitor 39 is connected to both ends of capacitor 37 through a heating coil 41 which is provided at the rear surface of top plate 1 of apparatus body 3 in such a way that it is positioned oppositely apart from top plate 1. A resonant circuit 43 includes capacitor 39 and heat coil 41. The collector of a power transistor 45 (NPN Type) is connected to one of the terminals of capacitor 39, and the emitter thereof is connected to another terminal of capacitor 39. The base of power transistor 45 is connected to a power drive circuit 47. An inverter circuit 49, which activates resonant circuit 43, is composed of rectifier circuit 31, capacitor 39 and transistor 45. The input of power drive circuit 47 is connected to the output of an oscillator control circuit 51. A current transformer 53 is provided in the alternating current line between rectifier circuit 31 and A.C. power source 33. The output of current transformer 53 is connected to the input of oscillator control circuit 51.

As can be seen in FIG. 2, a micro computer 55, including CPU **55*a* ROM 55*b*, RAM 55*c* and A/D (analogue/digital) converter, 55*d*, is provided for controlling each display and oscillator control circuit 51. A timer variable resistor 19*a*, cooking mode select switch 21*a*, power level variable resistor 23*a* and oscillator control circuit 51 are connected to micro computer 55. Timer display 5, cooking mode display 7 and level display 9 are also connected to micro computer 55. Micro computer 55 provides digital signals 57 to timer display 5, cooking mode display 7, power level display 9 and cooking mode select switch 21. The resistance value of above-described timer variable resistor 19*a* changes in response to the sliding timer set knob 19. The resistance value of power level variable resistor 23*a* changes in response to the sliding of power level set knob 23. Cooking mode select knob 21 has a plurality of contacts, e.g. three contacts in this embodiment. These contacts are selectively switched on and off according to the position of cooking select knob 21. Oscillator control circuit 51 drives transistor 45 on and off through power drive circuit 47 on the basis of the commands from micro computer 55 and the output of current transformer 53**.

The operation of the above-described construction of the control circuit will be described below. Power switch 35 is turned on, and a saucepan (not shown) is set at the prescribed position, i.e. the position corresponding to heating coil 41, of top plate 1. A desired cooking mode is then selected with cooking mode select knob 21. If the "HEATING" mode is selected, micro computer 55 sends a signal to cooking mode display 7 to turn on first light-emitting diode **7*a* indicating "HEATING" mode and enables power control display 15 of power level display 9 to be operated. If the "FRYING" mode or "KEEP WARM" mode are selected, micro computer 55 turns on second light-emitting diode 70 indicating "FRYING" mode or third light-emitting diode 7*c* indicating "KEEP WARM" mode, and enables temperature control display 17** to be operated.

When cooking preparations are completed, the appropriate light-emitting diode of power control display 15 or temperature control display 17 is enabled and transistor 45 is switched on and off by power drive circuit 47 at a prescribed frequency, when power level set knob 23 is slid from the off position, as shown in FIG. 1, toward decrease direction of the resistance of power level variable resistor **23*a*. As transistor 45 is switched on and off and resonant circuit 43 is energized thereby, a high frequency current, produced by resonant circuit 43, flows through heating coil, and then a high frequency magnetic field generated by heating coil 41 is fed to the saucepan on top plate 1. At this point, the input-current flowing through the alternating current line is detected by current transformer 53, so that the presence, the material and the size of the saucepan are determined by micro computer 55 through oscillator control circuit 53 on the bases of signals such as the output of current transformer 53, the terminal voltage of resonating capacitor 39 and so forth. If a saucepan, whose material is suitable for this cooking apparatus, is located on the prescribed position of top plate 1 and a specific cooking mode of the power control is selected, the inverter circuit 49 is controlled by oscillator control circuit 51 through power drive circuit 47 so as to produce the heat output corresponding to the set position of power level set knob 23, i.e. the set resistance value of power level set knob 23. If a specific cooking mode of the temperature control is selected, micro computer 55 detects the difference between the temperature set by power level set knob 23 and the temperature of the saucepan sensed by a temperature sensor (not shown), and controls power drive circuit 47 through oscillator control circuit 51** so as to produce the heat output which causes the temperature difference to decrease. Thus, the regular cooking operations are carried out in the same manner as above-described operations.

Figure 3:
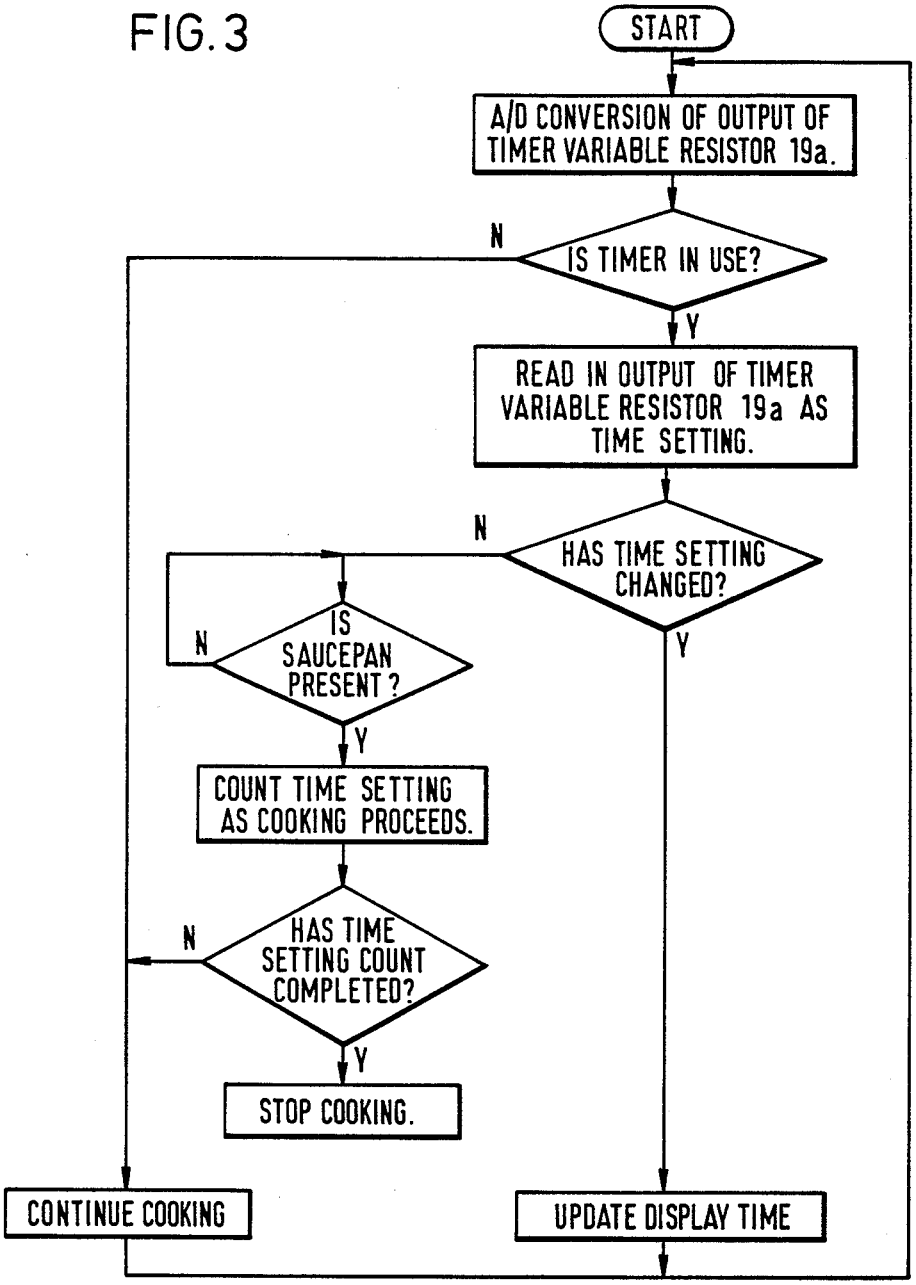
FIG. 3 is a flow chart detailing timer operation and explaining the method of the present invention.

The timer operation will be described hereinafter with reference to FIG. 3. Micro computer 55 reads the A/D converted output of timer variable resistor **19*a* corresponding to the position of timer set knob 19 and stores it into RAM before or during the cooking. Thus, micro computer 55 decides whether the timer operation is commanded or not according to the result of the comparison between the output data stored in RAM and the data being stored in ROM. For example, the "timer not-in-use" command is distinguished when timer set knob 19 is at the leftmost position (i.e. the output of timer variable resistor 19*a* is zero) on the one hand, and the "timer-in-use" command is distinguished when timer set knob 19 is slid to the right and away from the zero graduation (i.e. the output of timer variable resistor 19*a*** is a specific value) on the other hand.

When the "timer-in-use" command is distinguished, micro-computer 55 calculates the setting time on the basis of the output data of timer variable resistor **13*a* stored in RAM, and causes it to be indicated on display 13. Then, if microcomputer 55 detects the presence of the saucepan through oscillator control circuit 51, the timer operation is commenced, and the downcount operation of a counter (not shown) in micro-computer 55** is carried out with the progress of the cooking.

When the downcount operation is completed, microcomputer 55 feeds a stop signal to oscillator control circuit 51 to stop turning transistor 45 on and off through power drive circuit 47.

During timer operation, if timer set knob 19 is slid more than a certain distance within the "timer-in-use"

region, it is determined as an alteration of the setting time. A new setting time, the output of timer variable resistor 19*a*, based on the position of timer set knob 19 is read and converted into digital value and stored a RAM. Then, CPU causes the new setting time to be set in the counter and to be indicated on display 13.

As the alteration of the setting time may be determined only in such case that timer set knob is slid more than a certain distance, an unexpected alteration caused by, for example, an object knocking against timer set knob 13, is avoided. If timer set knob 13 is returned to the leftmost position, i.e. the zero graduation position, during the cooking, microcomputer 55 determines it as the "timer-not-in-use". When the "timer not-in-use" is discriminated, the timer operation is cancelled, and the cooking operation is continued irrespective of the setting time.

According to the above-described embodiment, the discrimination between "timer-in-use" and "timer-not-in-use" is made automatically in accordance with the position of timer set knob 13, no switch is required to enable or disable the timer control. Though timer set knob 13 is returned to the zero graduation position and the timer operation is cancelled, the cooking operation is continued without carrying out any operations.

In the above-described embodiment, the timer set knob is described as a sliding type, but the same implementation could be made with a rotary or other type of set knob.

The present invention overcomes the disadvantages of the prior art and provides an improved inductive heat cooking apparatus which enables the apparatus itself to continue a cooking operation under timer control while the user goes away from the apparatus and may continue the cooking operation without carrying out any resetting operations, even if the timer operation is cancelled while the cooking operation has been carried out. Many changes and modifications in the above-described embodiment should be evident to one of ordinary skill in this art without departing from the scope of the present invention. Therefore, the claims should be construed to include such modifications.

I claim:

1. A cooking apparatus comprising:

setting position means, including a variable resistor, for establishing a variable desired value based on a setting position thereof and producing an variable output signal corresponding to said desired valve when said setting position is within a predetermined range, and producing an output signal representing no desired valve when said setting position is outside said predetermined range;

timer means for counting until achieving a value indicated by said output signal of said setting position means;

means for detecting whether said timer means is operative based on said output of said setting position means;

means for cooking until said timer means counts to said desired value; and means for continuing said cooking indefinitely if said timer means is rendered inoperative by said output signal representing no desired value, before reaching said desired value.

2. The cooking apparatus according to claim 1, wherein said output signal is an analog signal.

3. The cooking apparatus according to claim 2 further including means for converting said output signal from an analog signal to a digital signal.

4. The cooking apparatus according to claim 3 further including means for entering a desired value data based on said variable output-signal into said timer means.

5. The cooking apparatus according to claim 4, wherein said timer means includes means for downcounting said desired value data.

6. The cooking apparatus according to claim 5, further including means for sensing the presence of an object to be heated, said timer means commencing downcounting when said sensing means senses the presence of the object.

7. The cooking apparatus according to claim 6, further including means for displaying said desired value data and remaining value data with progress of downcounting.

* * * * *